US009375649B2

(12) United States Patent
Colquhoun et al.

(10) Patent No.: US 9,375,649 B2
(45) Date of Patent: Jun. 28, 2016

(54) TOY VEHICLE

(71) Applicant: Mattel, Inc., El Segundo, CA (US)

(72) Inventors: Christian Colquhoun, Los Angeles, CA (US); William Willett, Mountain Center, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/817,435

(22) Filed: Aug. 4, 2015

(65) Prior Publication Data

US 2016/0038846 A1 Feb. 11, 2016

Related U.S. Application Data

(60) Provisional application No. 62/033,255, filed on Aug. 5, 2014.

(51) Int. Cl.
*A63H 17/26* (2006.01)

(52) U.S. Cl.
CPC ..... *A63H 17/262* (2013.01)

(58) Field of Classification Search
USPC ..... 446/431, 434, 437, 465, 466, 469, 470
See application file for complete search history.

(56) References Cited

U.S. PATENT DOCUMENTS

| | | | | |
|---|---|---|---|---|
| 2,054,842 | A | | 9/1936 | Walker |
| 2,186,065 | A | | 1/1940 | Fischer |
| 3,063,194 | A | | 11/1962 | Berguerand |
| 3,083,499 | A | | 4/1963 | Balthazor |
| 3,083,500 | A | | 4/1963 | Balthazor |
| 3,144,731 | A | | 8/1964 | Baxter |
| 3,162,978 | A | | 12/1964 | Balthazor |
| 3,613,307 | A | | 10/1971 | Baynes |
| 3,720,017 | A | | 3/1973 | Ersilio |
| 3,721,042 | A | | 3/1973 | Marason, Jr. |
| 4,159,126 | A | | 6/1979 | Raleigh |
| 4,457,099 | A | | 7/1984 | Kozuka |
| 4,602,800 | A | | 7/1986 | Persson |
| 4,666,420 | A | | 5/1987 | Nagano |
| 4,696,655 | A | | 9/1987 | D'Andrade |
| 4,822,316 | A | | 4/1989 | Shaffer |
| 5,108,126 | A | | 4/1992 | Banse |
| 5,167,563 | A | | 12/1992 | Saffer |
| 5,322,469 | A | | 6/1994 | Tilbor |
| 5,338,246 | A | | 8/1994 | Suto |
| 5,609,510 | A | * | 3/1997 | Stubenfoll ..... A63H 17/26 446/437 |
| 5,643,041 | A | * | 7/1997 | Mukaida ..... A63H 31/00 280/39 |
| 5,676,585 | A | * | 10/1997 | Nuermberger, III . A63H 17/262 446/424 |

(Continued)

*Primary Examiner* — Kurt Fernstrom
(74) *Attorney, Agent, or Firm* — Edell, Shapiro & Finnan, LLC

(57) ABSTRACT

In the present disclosure, disclosed herein, is a toy vehicle. The toy vehicle may include a front portion including a first arm, a second arm, and a first support member coupled to the first arm and the second arm; and a rear portion including a third arm, a fourth arm, and a second support member coupled to the third arm and the fourth arm. The toy vehicle may also include a plurality of wheels in which a first wheel of the plurality of wheels is coupled to the front portion and a second wheel of the plurality of wheels is coupled to the rear portion. An adjustment mechanism includes an actuator and a receiver. The actuator is engaged with the receiver and is rotatable relative thereto. The receiver is movable between a first position in which the receiver is spaced apart from the first support member and the second support member, and a second position in which the receiver contacts the first support member and the second support member.

20 Claims, 6 Drawing Sheets

(56) References Cited

U.S. PATENT DOCUMENTS

| | | | | |
|---|---|---|---|---|
| 5,762,533 | A * | 6/1998 | Tilbor | A63H 17/262 280/43.23 |
| 5,951,363 | A * | 9/1999 | Uetake | A63H 17/004 446/456 |
| 6,394,876 | B1 * | 5/2002 | Ishimoto | A63H 17/004 446/427 |
| 6,394,878 | B1 | 5/2002 | Wang | |
| 6,478,655 | B2 | 11/2002 | Wu | |
| 6,589,098 | B2 | 7/2003 | Lee | |
| 6,599,169 | B2 | 7/2003 | Edmisson | |
| 6,604,982 | B1 | 8/2003 | Croteau | |
| 6,620,023 | B2 | 9/2003 | Yeung | |
| 6,749,482 | B1 | 6/2004 | Hollis | |
| 6,752,684 | B1 | 6/2004 | Lee | |
| 6,758,719 | B1 | 7/2004 | Nava | |
| 6,764,376 | B2 * | 7/2004 | Agostini | A63H 17/26 446/466 |
| 6,767,272 | B2 | 7/2004 | Santarsiero | |
| 6,793,555 | B1 | 9/2004 | Tilbor | |
| 6,881,122 | B2 | 4/2005 | Bloch | |
| 6,926,581 | B2 | 8/2005 | Lynders | |
| 6,997,774 | B2 | 2/2006 | Kaneko | |
| 7,033,241 | B2 * | 4/2006 | Lee | A63H 17/00 446/427 |
| 7,094,125 | B2 | 8/2006 | Kaneko | |
| 7,317,118 | B2 | 1/2008 | Lo | |
| 7,335,084 | B2 | 2/2008 | Sato | |
| 7,654,879 | B2 | 2/2010 | Dunham | |
| 7,749,047 | B2 | 7/2010 | Dunham | |
| 7,887,074 | B2 | 2/2011 | Byers | |
| 8,002,606 | B2 | 8/2011 | Wong | |
| 8,231,427 | B2 | 7/2012 | Wong | |
| 8,267,739 | B2 * | 9/2012 | Ishibashi | A63H 17/004 446/427 |
| 8,469,767 | B2 | 6/2013 | Rehkemper | |
| 2002/0077026 | A1 | 6/2002 | Li | |
| 2008/0096462 | A1 | 4/2008 | Araki | |
| 2008/0268744 | A1 | 10/2008 | Jones | |
| 2012/0208429 | A1 | 8/2012 | Sheridan | |

* cited by examiner

TOY VEHICLE

CROSS-REFERENCE TO RELATED APPLICATION

This application claims priority to and the benefit of U.S. Provisional Patent Application No. 62/033,255, filed Aug. 5, 2014, entitled "Toy Vehicle" the entire disclosure of which is incorporated herein by reference in its entirety.

BACKGROUND OF THE INVENTION

Toy vehicles with at least one wheel such as cars, trucks, or motorcycles, have long been a source of entertainment for children. For example, toy vehicles have been designed for racing, performing stunts, transforming, and other creative play. The variation in themes and features spark the imagination of a child and provide continued engagement which adds to the play value.

Due to the continued popularity, there remains a continuing need in the art for ever more interesting, amusing and entertaining toys.

SUMMARY OF THE INVENTION

A toy vehicle is disclosed herein. In one embodiment, the toy vehicle comprises a front portion including a first arm, a second arm, and a first support member coupled to the first arm and the second arm; and a rear portion including a third arm, a fourth arm, and a second support member coupled to the third arm and the fourth arm. The toy vehicle also includes a plurality of wheels in which a first wheel of the plurality of wheels is coupled to the front portion and a second wheel of the plurality of wheels is coupled to the rear portion. An adjustment mechanism includes an actuator and a receiver. The actuator is engaged with the receiver and is rotatable relative thereto. The receiver is movable between a first position in which the receiver is spaced apart from the first support member and the second support member, and a second position in which the receiver contacts the first support member and the second support member.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

In the present disclosure, disclosed herein, is a toy vehicle. In one embodiment, the toy vehicle comprises a front portion including a first arm, a second arm, and a first support member coupled to the first arm and the second arm; and a rear portion including a third arm, a fourth arm, and a second support member coupled to the third arm and the fourth arm. The toy vehicle also includes a plurality of wheels in which a first wheel of the plurality of wheels is coupled to the front portion and a second wheel of the plurality of wheels is coupled to the rear portion. An adjustment mechanism includes an actuator and a receiver. The actuator is engaged with the receiver and is rotatable relative thereto. The receiver is movable between a first position in which the receiver is spaced apart from the first support member and the second support member, and a second position in which the receiver contacts the first support member and the second support member.

In one aspect, the actuator may include threads and the receiver may include grooves that receive the threads. The receiver is movable relative to the plurality of wheels. The receiver may move toward and away from the plurality of wheels when the actuator is rotated. In the first position, the receiver is in a raised position relative to the plurality of wheels, and in the second position, the receiver is in a lower position compared to the receiver in the first position. The receiver may be located between the front portion and the rear portion. Furthermore, the receiver may be located between the first arm and second arm of the front portion and the third arm and fourth arm of the rear portion.

The front portion may be pivotally coupled to the rear portion. In one embodiment, the front portion and the rear portion may be movable relative to the plurality of wheels when the receiver is in the first position. In another embodiment, the front portion and the rear portion may be immovable relative to the plurality of wheels when the receiver is in the second position.

The toy vehicle may further comprise a frame coupled to the front portion and the rear portion. The front portion and the rear portion may be movable relative to the frame. A body may be coupled to the frame.

Figure 1:
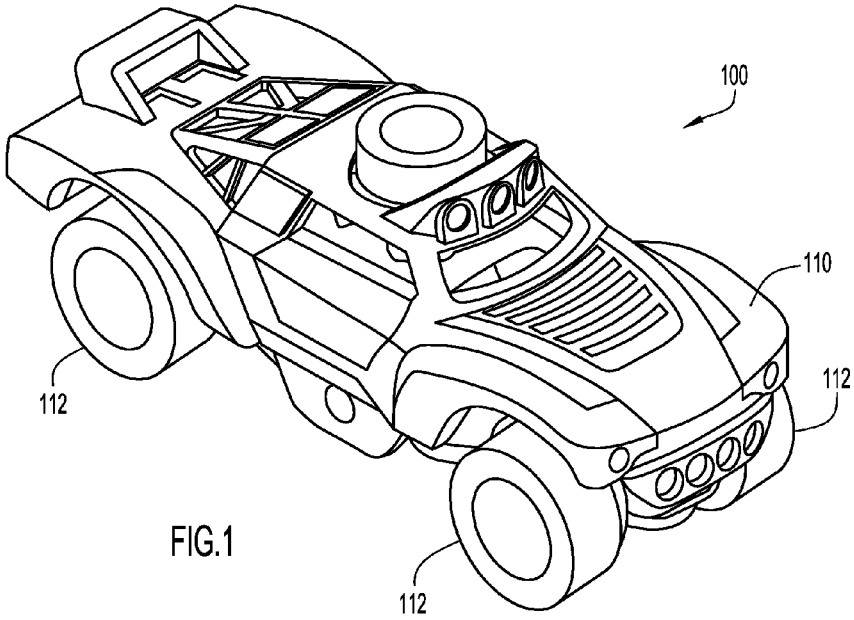
FIG. 1 is a perspective view of an exemplary toy vehicle.
Figure 2:
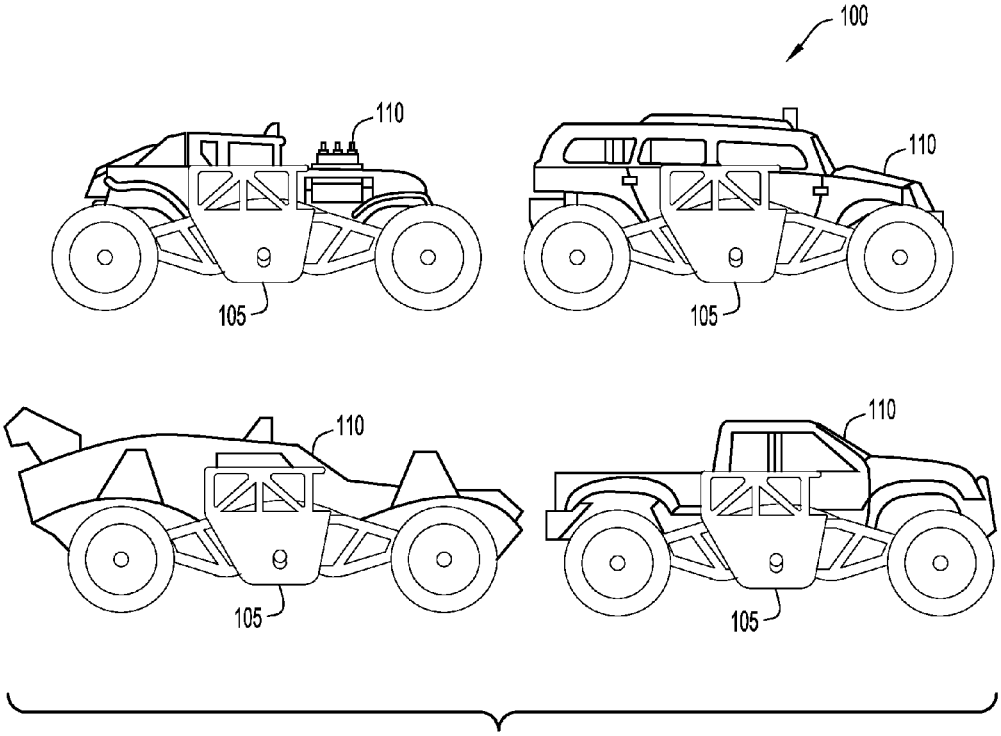
FIG. 2 is a side view of several embodiments of exemplary toy vehicles.

FIG. 1 is a perspective view of an exemplary toy vehicle. In this embodiment, the toy vehicle 100 is shown as a truck but may be of any design with at least one axle. For example, the toy vehicle 100 may be a truck, car, motorcycle, boat or airplane. The toy vehicle 100 has a body 110 and a plurality of wheels 112. In another embodiment, the body 110 may be reconfigurable or interchangeable by a snap-fit design, fasteners, magnets, hook-and-loop fasteners or the like, depicting different types of trucks such as a dune buggy, utility, road racer or pickup truck. FIG. 2 illustrates several different embodiments of a reconfigurable or interchangeable body 110, in which different designs of the body 110 are placed on a base structure 105. The toy vehicle 100 comprised of the various components described herein may be constructed from metal, plastic, composite material or the like, or any combination of materials.

Figure 3:
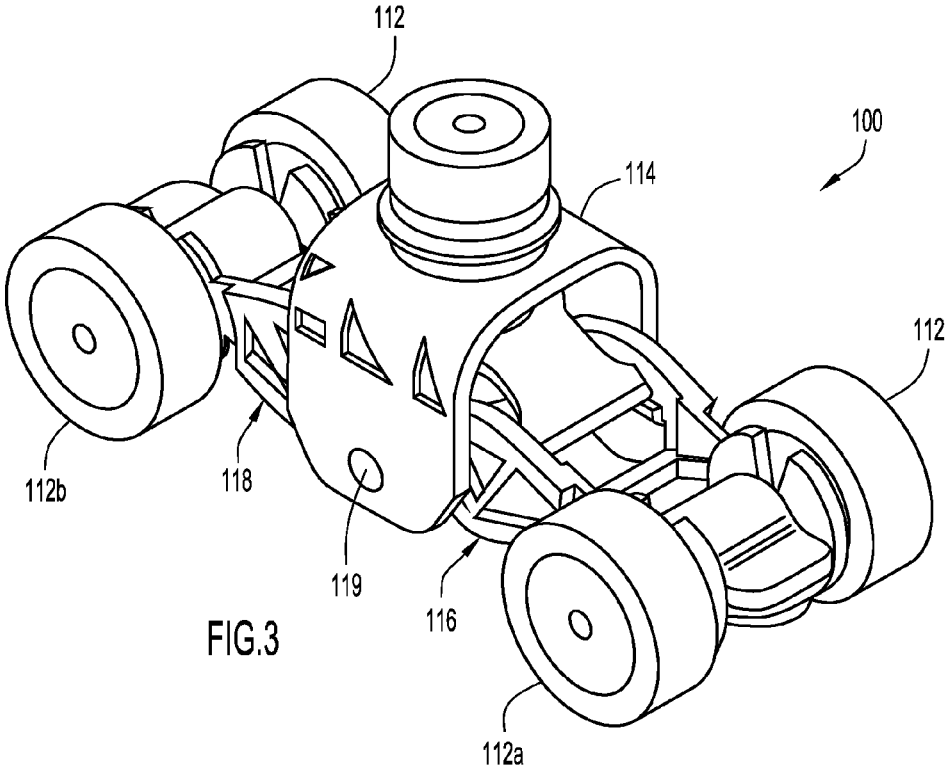
FIG. 3 is a perspective view of the toy vehicle illustrated in FIG. 1 with an outer body or shell removed.
Figure 4:
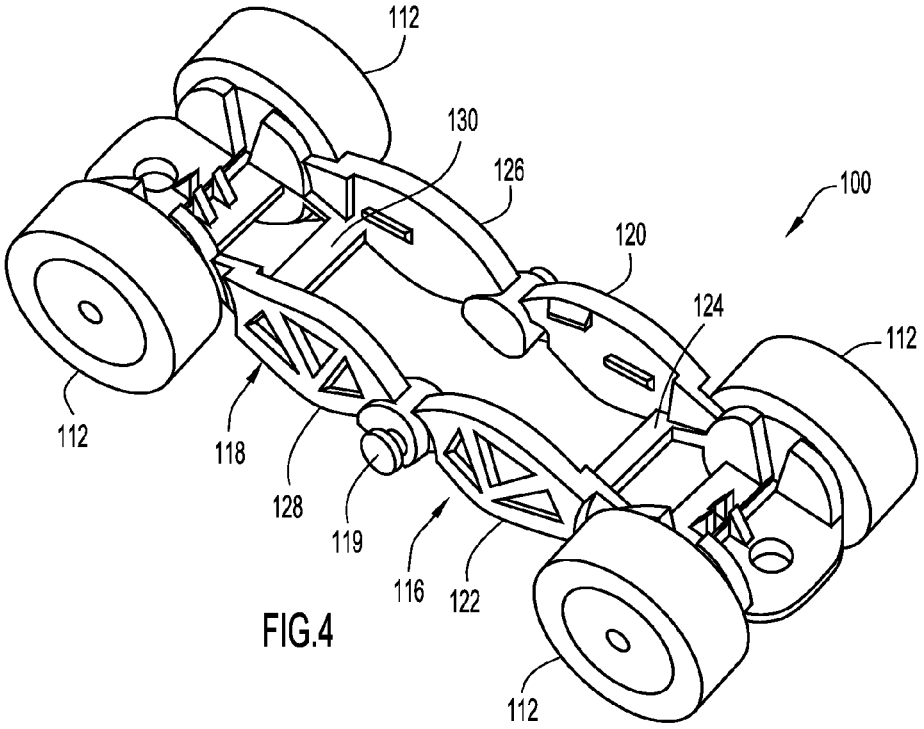
FIG. 4 is a perspective view of the front portion and the rear portion of the toy vehicle illustrated in FIG. 1.

FIG. 3 is a perspective view of an example toy vehicle 100 with the body 110 not shown for illustration purposes. The toy vehicle 100 also includes a frame 114, a front portion 116 and rear portion 118. In one embodiment, a first wheel 112*a* of the plurality of wheels 112 is coupled to the front portion 116 and a second wheel 112*b* of the plurality of wheels 112 is coupled to the rear portion 118. The front portion 116 may be pivotally coupled to the rear portion 118 at a pivot 119, which is a pin joint in this embodiment. As shown in FIG. 4, there is a pivot 119 on both sides of the toy vehicle 100. The frame 114 may be coupled to the front portion 116 and the rear portion 118 also at the pivot 119. The coupling of the frame 114 to the front portion 116 and rear portion 118 may be by snap-fit design, fasteners, a slotted channel, magnets, hook-and-loop fasteners or the like. The front portion 116 and the rear portion 118 may be movable relative to the frame 114. The body 110 depicted in FIG. 1 may be coupled to the frame 114 of FIG. 3 by snap-fit design, fasteners, a slotted channel, magnets, hook-and-loop fasteners or the like.

FIG. 4 is a perspective view of the front portion 116 and the rear portion 118 of an exemplary toy vehicle 100. In one embodiment, the front portion 116 includes a first arm 120, a second arm 122, and a first support member 124 coupled to the first arm 120 and the second arm 122. The front portion 116 may be formed as one integral component, for example by a stamping process, a molding process, or the like, or be separate components coupled to one another. The rear portion 118 includes a third arm 126, a fourth arm 128, and a second support member 130 coupled to the third arm 126 and the fourth arm 128. The rear portion 118 may also be formed as one integral component or be separate components coupled to one another. The front portion 116 may be pivotally coupled to the rear portion 118 at a pivot 119.

Figure 5:
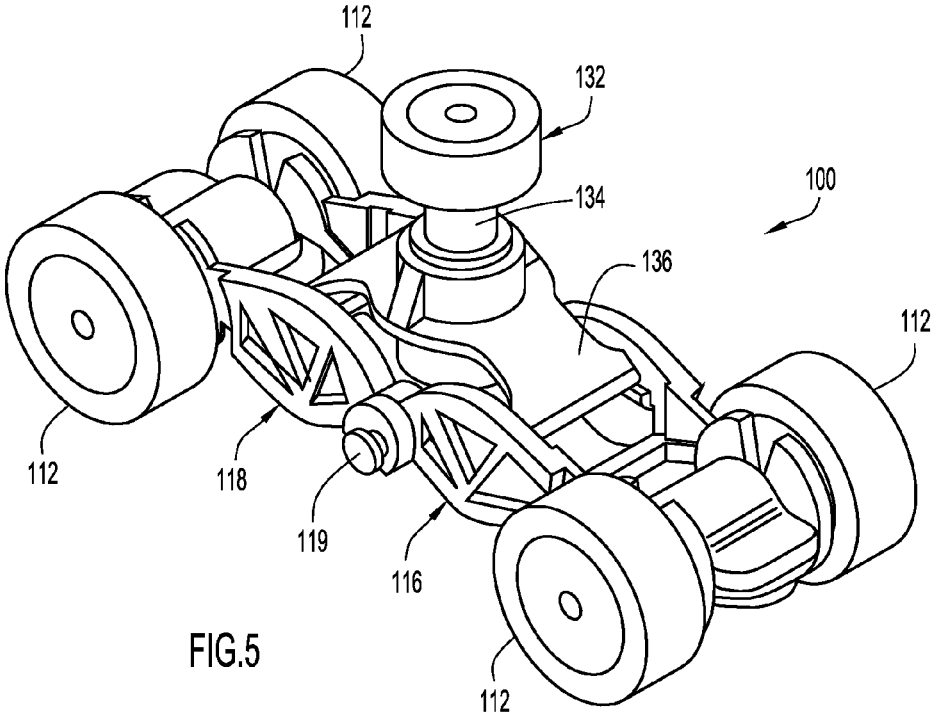
FIG. 5 is a perspective view of some components of the toy vehicle illustrated in FIG. 1.
Figure 6:
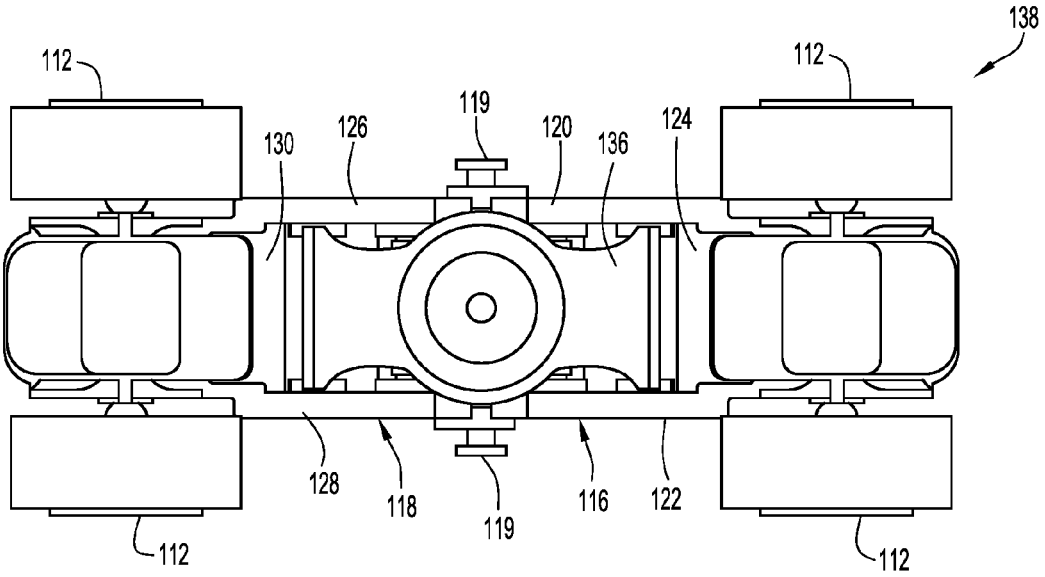
FIG. 6 is a top view of the components illustrated in FIG. 5.

FIG. 5 is a perspective view of an exemplary toy vehicle 100 with the body 110 and frame 114 not shown for illustration purposes. The toy vehicle 100 also includes an adjustment mechanism 132 having an actuator 134 and a receiver 136. The actuator 134 engages with the receiver 136 and is rotatable relative thereto. In one embodiment, the actuator 134 may include threads and the receiver 136 may include grooves that receive the threads on the actuator 134. In other embodiments, the actuator 134 and receiver 136 may be configured to move with a linear motion relative to each other rather than a rotating motion, such as with a pneumatic piston, or rack and pinion. The receiver 136 may be located between the front portion 116 and the rear portion 118. Furthermore, the receiver 136 may be located between the first arm 120 and second arm 122 (FIG. 4) of the front portion 116 and the third arm 126 and fourth arm 128 (FIG. 4) of the rear portion 118. The front portion 116, the rear portion 118 and adjustment mechanism 132 may be referred to in this disclosure as a suspension system. FIG. 6 is a top view of the toy vehicle 100 showing one embodiment of the suspension system 138.

The suspension system 138 of toy vehicle 100 is active and customizable, having a first mode in which the suspension system 138 is placed in a first position, a second mode in which the suspension system 138 is placed in a second position and a third mode in which the suspension system 138 is placed anywhere between the first position and the second position. The receiver 136 may move toward and away from the plurality of wheels 112 when the actuator 134 is rotated. The receiver 136 is movable between a first position in which the receiver 136 is spaced apart from the first support member 124 and the second support member 130, and a second position in which the receiver 136 contacts the first support member 124 and the second support member 130.

Figure 7:
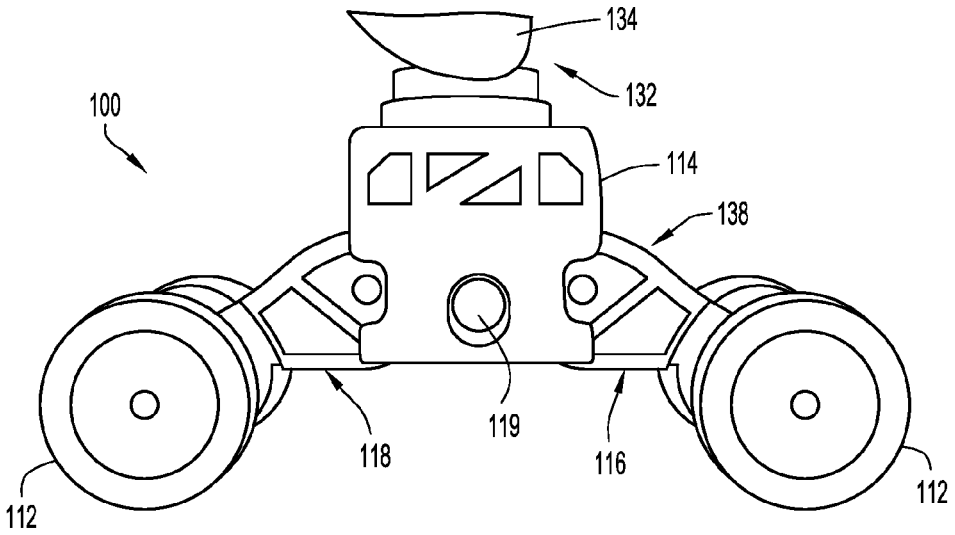
FIG. 7 is a side view of some components of another embodiment of a toy vehicle with its suspension system in a first mode or position.
Figure 8:
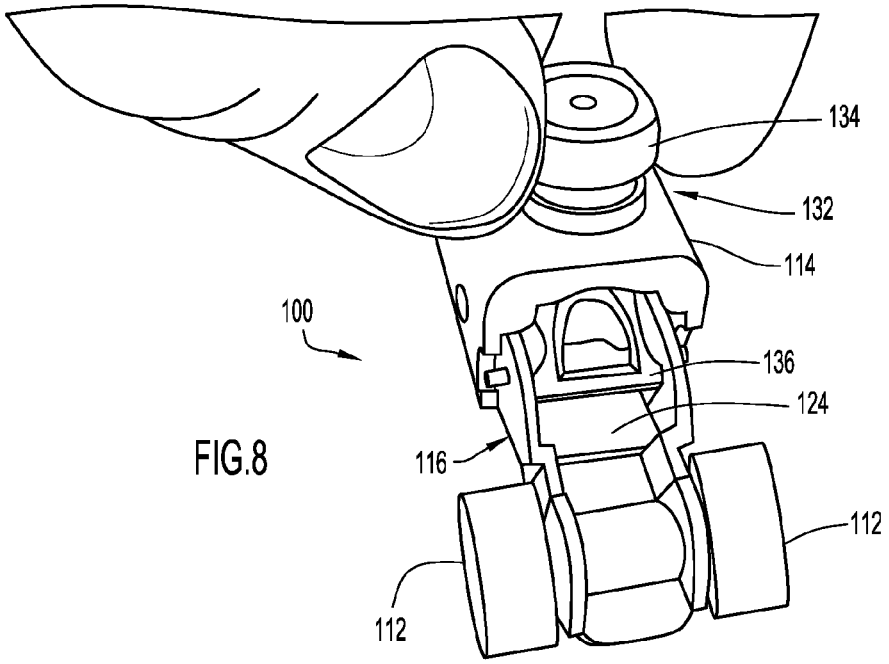
FIG. 8 is a front view of the toy vehicle illustrated in FIG. 7.

FIG. 7 depicts a side view of another embodiment of the toy vehicle 100 in the first mode in which the suspension system 138 is placed in the first position and FIG. 8 depicts a front view of the toy vehicle 100 in the first mode in which the suspension system 138 is placed in the first position. In the first position, the adjustment mechanism 132 is disengaged from the support members 124 and 130. As shown, the actuator 134 has been rotated in a first direction, such as counterclockwise, which moves the receiver 136 upwardly so that the receiver 136 is spaced apart from the first support member 124 and support member 130. The receiver 136 is movable relative to the plurality of wheels 112 and is in a raised position relative to the plurality of wheels 112. In this first position of the suspension system 138, the front portion 116 and the rear portion 118 are angled toward each other. The front portion 116 and the rear portion 118 are movable relative to the plurality of wheels 112 when the receiver 136 is in the first position, since the receiver 136 can freely move between its spaced apart position from the support members 124 and 130, to where it contacts support members 124 and 130.

In the first position, the suspension system 138 is compliant allowing flexibility, give or play in the toy vehicle 100 as it absorbs forces from impacts such as from uneven surfaces. For example, when the toy vehicle 100 lands after a drop or fall, the forces are absorbed or dampened allowing the toy vehicle 100 to land softly and upright as opposed to bouncing in an uncontrolled fashion. Additionally, if the toy vehicle 100 encounters rough terrain, the complaint suspension system 138 in the first position enables stability of the toy vehicle 100 while negotiating unleveled surfaces or obstacles. During play, the first mode with the suspension system 138 in the first position may be used as a stunt mode or for off-roading.

Figure 9:
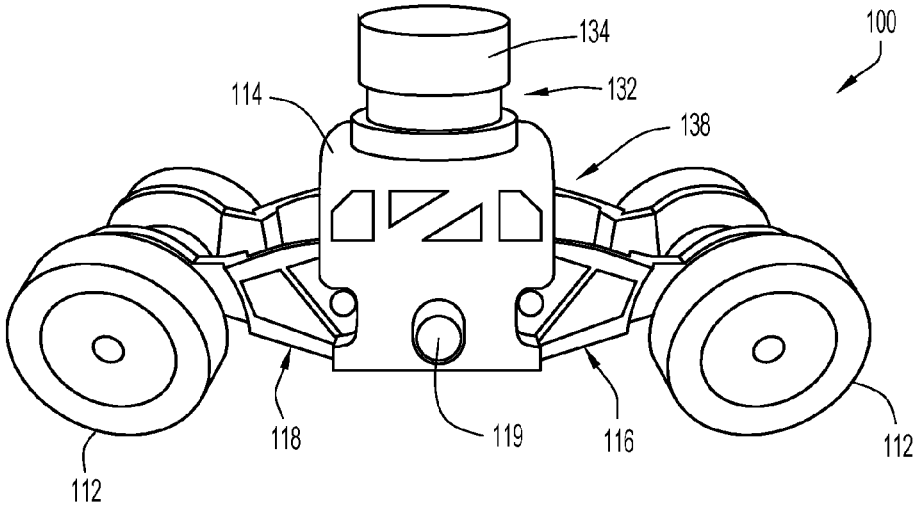
FIG. 9 is a side view of the components of the toy vehicle illustrated in FIG. 7 with the suspension system in a second mode or position.
Figure 10:
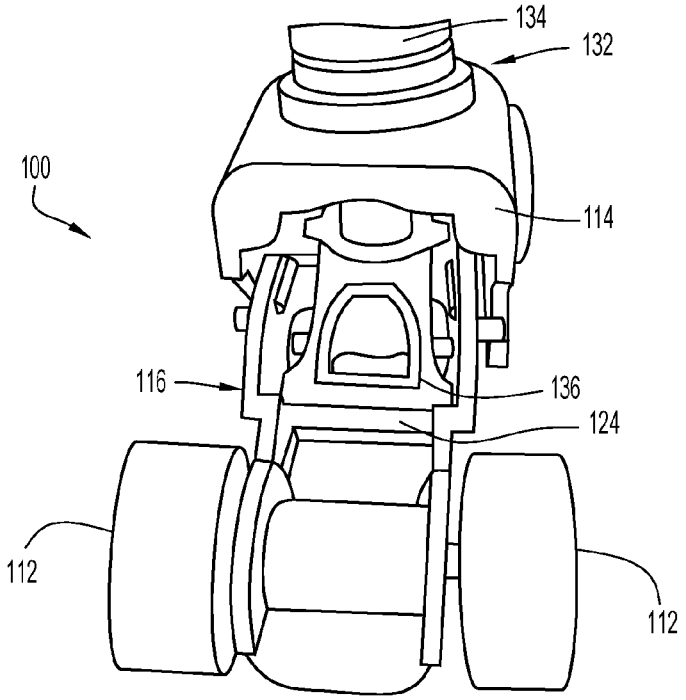
FIG. 10 is a front perspective view of the toy vehicle illustrated in FIG. 9.

FIG. 9 is a side view of the toy vehicle 100 in the second mode in which the suspension system 138 is placed in the second position and FIG. 10 is a front view of the toy vehicle 100 in the second mode in which the suspension system 138 is placed in the second position. In the second mode the adjustment mechanism 132 is engaged, in which the actuator 134 has been rotated in the opposite direction of the first mode, such as clockwise, causing the receiver 136 to move downward until contacting the first support member 124 and the second support member 130. In this position, the receiver 136 is immovable relative to the plurality of wheels 112, because the contact with the support members 124 and 130 disables any space for movement of the receiver 136. The receiver 136 is in a lower position compared to the receiver 136 in the first position. In the embodiment of FIGS. 9 and 10, the front portion 116 and rear portion 118 are approximately aligned with each other in the second position. The front portion 116 and the rear portion 118 may be immovable relative to the plurality of wheels 112 when the receiver 136 is in the second position.

In the second position, the suspension system 138 is rigid and stiff allowing for optimal vehicle handling characteristics on smooth surfaces. For example, when the toy vehicle 100 is traveling on a race track set, the handling characteristics and performance while the toy vehicle 100 is moving and negotiating curves are enhanced. However, when the toy vehicle 100 lands after a drop or fall, the suspension system 138 is now stiff and the forces are not thoroughly absorbed by the suspension system 138. The toy vehicle 100 may bounce and overturn in an uncontrolled fashion. During play, the second mode with the suspension system 138 in the second position may be useful during a race mode, traveling on smooth surfaces, or with a toy launcher on a track set that launches the toy from the rear location.

Figure 11:
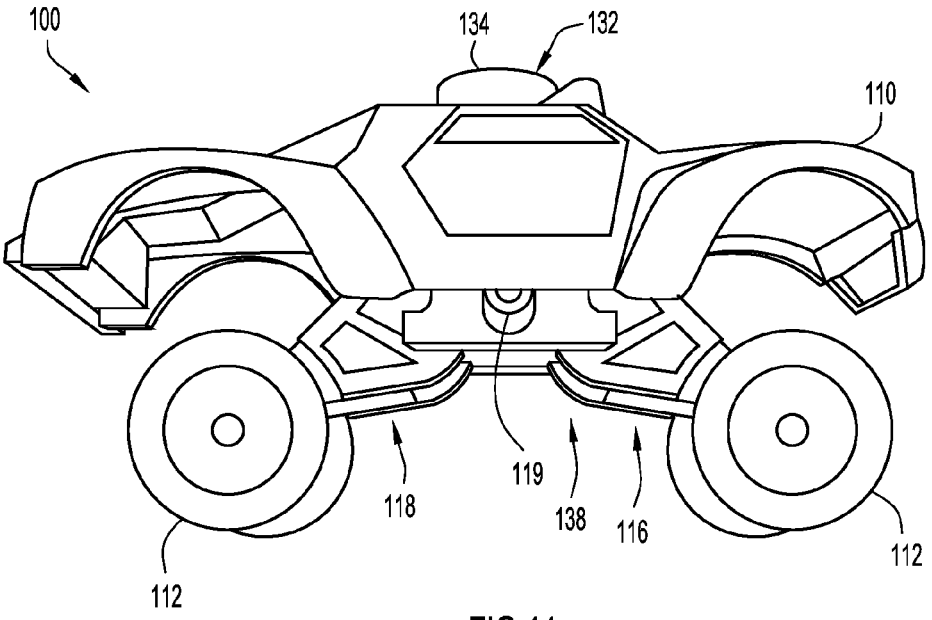
FIG. 11 is a side view of another embodiment of a toy vehicle with its suspension system in a first mode or position.
Figure 12:
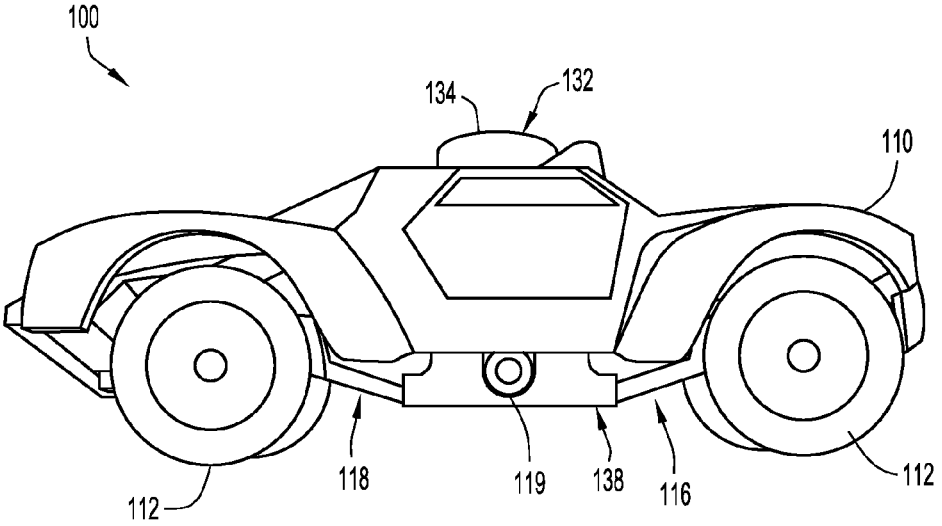
FIG. 12 is a side view of the toy vehicle illustrated in FIG. 11 with its suspension system in a second mode or position.

FIG. 11 shows a side view of another embodiment of the toy vehicle 100 with the suspension system 138 in the first mode. FIG. 12 shows a side view of the toy vehicle 100 of FIG. 11 with the suspension system 138 in the second mode.

Because the suspension system 138 is customizable, in the third mode, the suspension system 138 may be placed anywhere between the first position and the second position. The adjustment mechanism 132 is engaged, thus the actuator 134 is rotated clockwise causing the receiver 136 to move downward toward the first support member 124 and the second support member 130. The actuator 134 and receiver 136 are positively engaged with each other, such as with threads and grooves, allowing the receiver 136 to be held in an intermediate position between the first and second positions. In this mode, the suspension system 138 has varying degrees of flexibility, allowing the user to decide on how the toy vehicle 100 will handle. For example, this configuration may be useful when the toy vehicle 100 is used on a mixture of surfaces or terrain, or on particular track sets depending on the complexity of straight paths, curves, ramps, loops and obstacles.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

The invention claimed is:

1. A toy vehicle, comprising:

a front portion including a first support member and at least one front wheel;

a rear portion connected to the front portion and including a second support member and at least one rear wheel; and a manual adjustment mechanism including an actuator and a receiver, the actuator being engaged with the receiver and moveable relative thereto between a first receiver position in which the receiver is spaced apart from the first support member and the second support member, and a second receiver position in which the receiver contacts the first support member and the second support member, the adjustment mechanism changing the angular orientation of the front portion and the rear portion with respect to one another.

2. The toy vehicle of claim 1, wherein:

in the first receiver position, the receiver is in a raised position relative to the at least one front wheel and at least one rear wheel; and in the second receiver position, the receiver is in a lower position compared to the receiver in the first receiver position.

3. The toy vehicle of claim 1, wherein the receiver is located between the front portion and the rear portion.

4. The toy vehicle of claim 1, wherein the actuator rotates with respect to the receiver, moving the receiver between the first receiver position and the second receiver position.

5. The toy vehicle of claim 4, wherein:

the actuator includes threads;

the receiver includes grooves that receive the threads of the actuator; and the receiver moves toward and away from the at least one front wheel and at least one rear wheel when the actuator is rotated.

6. The toy vehicle of claim 1, wherein the front portion is pivotally coupled to the rear portion.

7. The toy vehicle of claim 1, wherein in the first receiver position, the front portion and the rear portion are movable with respect to one another.

8. The toy vehicle of claim 1, wherein in the second receiver position, the front portion and the rear portion are immovable with respect to one another.

9. The toy vehicle of claim 1, further comprising a frame coupled to the front portion and the rear portion, the front portion and the rear portion being movable relative to the frame.

10. The toy vehicle of claim 9, wherein a toy vehicle body is coupled to the frame.

11. A toy vehicle, comprising:

a front portion including a first support member;

a rear portion including a second support member, the rear portion pivotally coupled to the front portion;

a plurality of wheels, a first wheel of the plurality of wheels coupled to the front portion and a second wheel of the plurality of wheels coupled to the rear portion; and a manual adjustment mechanism operably coupled to the front portion and the rear portion and including an actuator and a receiver, the actuator being engaged with the receiver and rotatable relative thereto between a first receiver position and a second receiver position for adjusting the angular orientation of the front portion and the rear portion with respect to one another.

12. The toy vehicle of claim 11, wherein:

in the first receiver position, the receiver is in a raised position relative to the plurality of wheels; and in the second receiver position, the receiver is in a lower position compared to the receiver in the first receiver position.

13. The toy vehicle of claim 11, wherein the receiver is located between the front portion and the rear portion.

14. The toy vehicle of claim 11, wherein the actuator rotates with respect to the receiver, moving the receiver linearly between the first receiver position and the second receiver position.

15. The toy vehicle of claim 14, wherein:

the actuator includes threads;

the receiver includes grooves that receive the threads of the actuator; and the receiver moves toward and away from the plurality of wheels when the actuator is rotated.

16. The toy vehicle of claim 11, wherein in the first receiver position, the front portion and the rear portion are movable with respect to one another.

17. The toy vehicle of claim 1, wherein in the second receiver position, the front portion and the rear portion are immovable with respect to one another.

18. The toy vehicle of claim 11, further comprising a frame coupled to the front portion and the rear portion, the front portion and the rear portion being movable relative to the frame.

19. The toy vehicle of claim 18, wherein a toy vehicle body is coupled to the frame.

20. The toy vehicle of claim 11, wherein the receiver is spaced apart from the first support member and the second support member in the first receiver position, and the receiver contacts the first support member and the second support member in the second receiver position.

* * * * *